US009068270B2

(12) United States Patent
Hoshi et al.

(10) Patent No.: US 9,068,270 B2
(45) Date of Patent: Jun. 30, 2015

(54) ALUMINUM ELECTROPLATING SOLUTION AND METHOD FOR FORMING ALUMINUM PLATING FILM

(75) Inventors: Hiroyuki Hoshi, Osaka (JP); Atsushi Okamoto, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 1078 days.

(21) Appl. No.: 13/123,760

(22) PCT Filed: Jul. 31, 2009

(86) PCT No.: PCT/JP2009/063671

§ 371 (c)(1),
(2), (4) Date: Jul. 1, 2011

(87) PCT Pub. No.: WO2010/044305

PCT Pub. Date: Apr. 22, 2010

(65) Prior Publication Data

US 2011/0253543 A1 Oct. 20, 2011

(30) Foreign Application Priority Data

Oct. 15, 2008 (JP) ..... 2008-266131
Mar. 10, 2009 (JP) ..... 2009-056413

(51) Int. Cl.
*C25D 3/66* (2006.01)
*C25D 3/56* (2006.01)
(Continued)

(52) U.S. Cl.
CPC *C25D 3/665* (2013.01); *C25D 3/66* (2013.01); *C25D 3/44* (2013.01)

(58) Field of Classification Search
CPC ..... C25D 3/44; C25D 3/66; C25D 3/665
USPC ..... 205/233, 237, 261
See application file for complete search history.

(56) References Cited

U.S. PATENT DOCUMENTS 4,906,342 A 3/1990 Takahashi et al.
5,041,194 A * 8/1991 Mori et al. ..... 205/237
6,083,647 A * 7/2000 Noda et al. ..... 429/324

FOREIGN PATENT DOCUMENTS

CN 1542167 11/2004
EP 0 274 774 A1 7/1988
(Continued)

OTHER PUBLICATIONS

Legrand et al., "Raman Study of Aluminum Chloride-Dimethylsulfone Solutions", Inorg. Chem. (no month, 1996), vol. 35, pp. 1310-1312.*
Legrand et al., "Electrodeposition Studies of Aluminum on Tungsten Electrode from DMSO2 Electrolytes", J. Electrochem. Soc. (Feb. 1994), vol. 141, No. 2, pp. 378-382.*
(Continued)

*Primary Examiner* — Edna Wong
(74) *Attorney, Agent, or Firm* — Kratz, Quintos & Hanson, LLP

(57) ABSTRACT

An object of the present invention is to provide an extended-life plating solution that allows an aluminum electroplating process to be performed stably for a long period of time, and also a method for forming an aluminum plating film using the same. An aluminum electroplating solution according to the present invention is characterized by comprising 1.5 to 4.0 mol of an aluminum halide per 10.0 mol of dimethyl sulfone and, relative to the aluminum halide, ammonium chloride in a molar ratio of 1/15 to 1/4 or a tetraalkylammonium chloride in a molar ratio of 1/15 to 1/2. The plating solution has improved electrical conductivity and thus has a further advantage in that it allows the formation of a uniform aluminum plating film on a substrate to be plated even when the plating process is performed by a barrel method.

5 Claims, 5 Drawing Sheets

(51) Int. Cl.
*C25D 3/00* (2006.01)
*C25D 3/44* (2006.01)

(56) References Cited

FOREIGN PATENT DOCUMENTS

| | | | |
|---|---|---|---|
| JP | 2004-076031 | | 3/2004 |
| JP | 2004-346372 | A1 | 12/2004 |
| JP | 2006-161154 | A1 | 6/2006 |
| JP | 2007-291490 | | 11/2007 |
| JP | 2008-195989 | A1 | 8/2008 |

OTHER PUBLICATIONS

Fellner et al., "Electrolytic Aluminum Plating in Molten Salt Mixtures Based on AlCl3 I: Influence of the Addition of Tetramethylammonium Chloride", Surface Technology (Oct. 1981), vol. 14, pp. 101-108.*

Chinese Office Action dated Mar. 18, 2013, in the corresponding Chinese patent application No. 200980146014.1.

International Search Report for International Application No. PCT/JP2009/063671 dated Oct. 28, 2009.

Second Office Action issued in corresponding Chinese application No. 200980146014.1 dated Dec. 4, 2013.

* cited by examiner

ALUMINUM ELECTROPLATING SOLUTION AND METHOD FOR FORMING ALUMINUM PLATING FILM

TECHNICAL FIELD

The present invention relates to an aluminum electroplating solution and a method for forming an aluminum plating film using the same.

BACKGROUND ART

The aluminum electrodeposition potential is lower than the hydrogen evolution potential, and it thus is impossible to electrodeposit aluminum from its aqueous solution. For this reason, as aluminum electroplating solutions, those using a nonaqueous solvent have been often studied. As nonaqueous solvents, tetrahydrofuran, toluene, and the like are known. However, such solvents are problematic in that they are highly inflammable, and, therefore, most of them are not in actual use. Under such circumstances, as a relatively safe aluminum electroplating solution, Patent Document 1 reports a low-temperature molten salt electroplating solution prepared by mixing and melting dimethyl sulfone and an aluminum halide (aluminum chloride, etc.). Nevertheless, because the plating solution uses dimethyl sulfone as a nonaqueous solvent, the bath make-up cost is high. Therefore, in order to reduce the plating cost, it is necessary to extend the life of the plating solution. However, because the plating solution uses an aluminum halide of high hygroscopicity as a solute, it has the property of gradually absorbing moisture from the air, resulting in degradation. When a plating process is performed using a plating solution degraded due to the absorption of moisture, this is likely to cause the formation of a black film called burnt deposit (hereinafter simply referred to as "burnt deposit").

In an attempt to solve the above problems of the aluminum electroplating solution described in Patent Document 1, the present inventors have reported, in Patent Document 2, a method in which a plating solution is configured to contain dimethylamine borane so as to effectively remove moisture from the plating solution. However, a subsequent study on this method has revealed that when an increased amount of moisture is incorporated into the plating solution, this may cause a rapid reaction between dimethylamine borane and water, resulting in the ignition of the plating solution.

PRIOR ART DOCUMENTS

Patent Documents

Patent Document 1: JP-A-2004-76031
Patent Document 2: JP-A-2006-161154

DISCLOSURE OF THE INVENTION

Problems that the Invention is to Solve

Thus, the present invention is aimed to provide an extended-life plating solution that allows an aluminum electroplating process to be performed stably for a long period of time, and also a method for forming an aluminum plating film using the same.

Means for Solving the Problems

In light of the above points, the present inventors conducted extensive research. As a result, they found that a plating solution prepared by mixing and melting dimethyl sulfone, an aluminum halide, and ammonium chloride or a tetraalkylammonium chloride in a predetermined ratio (a low-temperature molten salt electroplating solution) allows an aluminum electroplating process to be performed stably for a long period of time even when the amount of moisture incorporated therein gradually increases. They also found that the plating solution has improved electrical conductivity and thus allows the formation of a uniform aluminum plating film on a substrate to be plated even when the plating process is performed by a barrel method.

An aluminum electroplating solution according to the present invention accomplished based on the above findings is, as defined in a first embodiment, characterized by comprising 1.5 to 4.0 mol of an aluminum halide per 10.0 mol of dimethyl sulfone and, relative to the aluminum halide, ammonium chloride in a molar ratio of 1/15 to 1/4 or a tetraalkylammonium chloride in a molar ratio of 1/15 to 1/2.

An aluminum electroplating solution as defined in a second embodiment is characterized in that in the aluminum electroplating solution according to the first embodiment, the aluminum halide is aluminum chloride.

An aluminum electroplating solution as defined in a third embodiment is characterized in that in the aluminum electroplating solution according to the first embodiment, the aluminum halide is an anhydride.

An aluminum electroplating solution as defined in a fourth embodiment is characterized in that in the aluminum electroplating solution according to the first embodiment, the tetraalkylammonium chloride is tetramethylammonium chloride.

A method for forming an aluminum plating film according to the present invention is, as defined in a fifth embodiment, characterized in that a substrate to be plated is placed as a cathode in an aluminum electroplating solution according to the first embodiment, and an electric current is passed therethrough to form an aluminum plating film on a surface of the substrate to be plated.

An article according to the present invention is, as defined in a sixth embodiment, characterized by comprising on a surface thereof an aluminum plating film formed by a method for forming an aluminum plating film according to the fifth embodiment.

Effect of the Invention

The present invention enables the provision of a plating solution that allows an aluminum electroplating process to be performed stably for a long period of time even when the amount of moisture incorporated therein gradually increases and, in addition, also allows the formation of a uniform aluminum plating film on a substrate to be plated even when the plating process is performed by a barrel method, and a method for forming an aluminum plating film using the same.

BEST MODE FOR CARRYING OUT THE INVENTION

Figure 1:
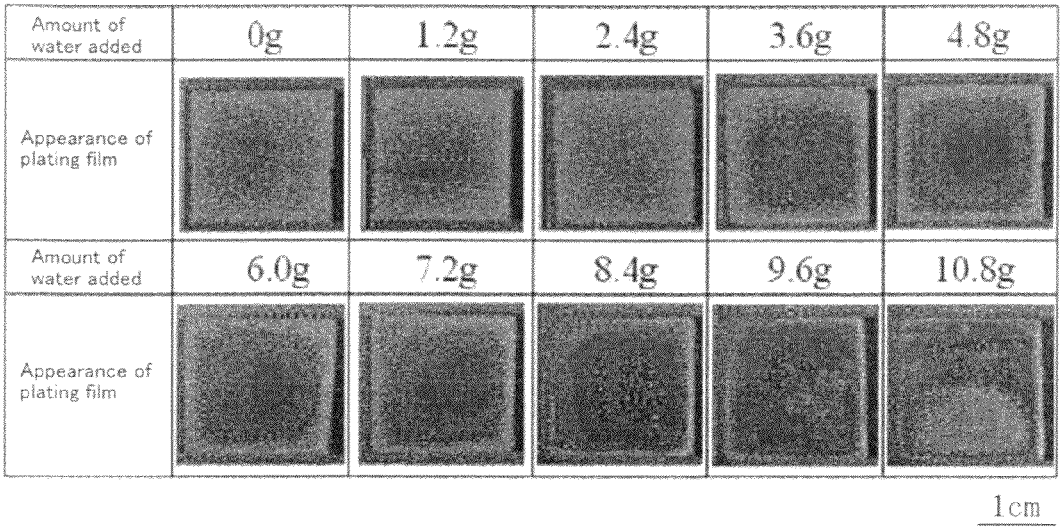
FIG. 1 Photographs showing the results of visual observation in Example 1, regarding the relationship between the amount of water added to a plating solution and the appearance of an aluminum plating film formed on the surface of an oxygen-free copper plate.

An aluminum electroplating solution according to the present invention is characterized by comprising 1.5 to 4.0 mol of an aluminum halide per 10.0 mol of dimethyl sulfone and, relative to the aluminum halide, ammonium chloride in a molar ratio of 1/15 to 1/4 or a tetraalkylammonium chloride in a molar ratio of 1/15 to 1/2. The aluminum electroplating solution according to the present invention allows a plating process to be performed stably for a long period of time even when the amount of moisture incorporated therein gradually increases. One reason for this is probably that because the aluminum electroplating solution contains ammonium chloride or a tetraalkylammonium chloride under specific composition, aluminum complex ions ($Al(DMSO_2)_3^{3+}$: $DMSO_2$ represents dimethyl sulfone. Electrochimica Acta, Vol. 40, No. 11, pp. 1711-1716, 1995), which contribute to the electrodeposition of aluminum, are stably present in the plating solution.

Examples of aluminum halides include aluminum chloride and aluminum bromide. In light of material cost, etc., aluminum chloride is suitable. From the viewpoint of minimizing the amount of moisture contained in the plating solution, it is preferable that the aluminum halide is an anhydride. The aluminum halide content is defined as 1.5 to 4.0 mol per 10.0 mol of dimethyl sulfone. This is because when the content is less than 1.5 mol, burnt deposits may be likely to occur, while when it is more than 4.0 mol, the solution resistance of the plating solution may be too high, whereby the applied voltage increases, leading to the decomposition of the plating solution. It is preferable that the aluminum halide content is 2.0 to 3.5 mol per 10.0 mol of dimethyl sulfone.

When the plating solution contains ammonium chloride, the content thereof is defined as 1/15 to 1/4 in terms of molar ratio to the aluminum halide. This is because when the content is less than 1/15, the effect of its presence in the plating solution, i.e., extension of the life of the plating solution or improvement of the electrical conductivity, may not be exhibited, while when it is more than 1/4, because of its hygroscopicity, the plating solution will easily absorb moisture, and this may result in the formation of bubbles in the plating solution, the occurrence of bare spots or uneven gloss, etc. It is preferable that the ammonium chloride content is 1/10 to 1/5 in terms of molar ratio to the aluminum halide.

When the plating solution contains a tetraalkylammonium chloride, examples of tetraalkylammonium chlorides include compounds having $C_{1-6}$ alkyl groups, such as tetramethylammonium chloride and tetraethylammonium chloride. In light of material cost, etc., tetramethylammonium chloride is suitable. The tetraalkylammonium chloride content is defined as 1/15 to 1/2 in terms of molar ratio to the aluminum halide. This is because when the content is less than 1/15, the effect of its presence in the plating solution, i.e., extension of the life of the plating solution or improvement of the electrical conductivity, may not be exhibited, while when it is more than 1/2, the amount of aluminum complex ions ($Al(DMSO_2)_3^{3+}$) present in the plating solution decreases, whereby a plating film may not be formed. It is preferable that the tetraalkylammonium chloride content is 1/10 to 2/5 in terms of molar ratio to the aluminum halide.

For the purpose of increasing the purity of the aluminum plating film to be formed, for example, the aluminum electroplating solution according to the present invention may also contain a dialkylamine hydrochloride such as dimethylamine hydrochloride, a trialkylamine hydrochloride such as trimethylamine hydrochloride, and the like.

A plating process using the aluminum electroplating solution according to the present invention can be performed as follows. For example, an anode made of aluminum (also serves as an aluminum ion supply source) and a substrate to be plated, which serves as a cathode, are placed in the plating solution, and plating is performed with the temperature of the plating solution being adjusted to 85 to 115° C. and the applied current density being adjusted to 2.0 to 7.5 A/dm$^2$. When the temperature of the plating solution is less than 85° C., the solution resistance of the plating solution may be too high, whereby the applied voltage increases, leading to the decomposition of the plating solution. Meanwhile, when the temperature is more than 115° C., this may accelerate the reaction between the aluminum plating film formed on the surface of the substrate to be plated and the plating solution, whereby more impurities are incorporated into the film, resulting in reduced purity. When the applied current density is less than 2.0 A/dm$^2$, the efficiency of film formation may decrease, while when it is more than 7.5 A/dm$^2$, burnt deposits may be likely to occur due to excessive current. It is preferable that the applied current density is 2.5 to 5.0 A/dm$^2$. The duration of the plating process depends on the desired thickness of the aluminum plating film (normally 20 to 100 μm), the temperature of the plating solution, the applied current density, and the like, and is usually 10 minutes to 3 hours. The method of plating may be a rack method or a barrel method. The aluminum electroplating solution according to the present invention has improved electrical conductivity and thus allows the formation of a uniform plating film on the substrate to be plated even when the plating process is performed by a barrel method. This, together with the capability to allow a plating process to be performed stably for a long period of time even when the amount of moisture incorporated therein gradually increases, can be characterized as advantages of the aluminum electroplating solution according to the present invention.

The substrate to be plated (article), which is to be treated by an aluminum electroplating process, is not limited as long as an aluminum plating film can be formed on the surface thereof by the aluminum electroplating process. It may be a metal material having electrical conductivity in itself or may also be a carbon material, a synthetic resin material, or the like having electrical conductivity imparted by forming a metal film (film of nickel, copper, zinc, etc.), for example, on the surface thereof. The substrate to be plated may also be a metal material having a metal film formed on the surface thereof. The formation of an aluminum plating film on the surface of the substrate to be plated can impart corrosion resistance or design features. Upon the aluminum electroplating process, from the viewpoint of minimizing the amount of moisture contained in the plating solution, it is preferable that the substrate to be plated is thoroughly dried. Further, as a pretreatment for the aluminum electroplating process, the substrate to be plated may be subjected to removal of an oxide film, which naturally forms on the surface thereof, using an organic acid or an inorganic acid. In addition, zincate process, electroless plating process, conductive anodization process, conductive chemical conversion process, and the like may also be performed. The aluminum plating film formed on the surface of the substrate to be plated may also be subjected to anodization process or hydrothermal oxidation process, thereby imparting abrasion resistance to the plating film or enhancing the corrosion resistance of the plating film.

EXAMPLES

Hereinafter, the present invention will be described in detail with reference to the examples, but the scope of the present invention is not limited to the following description in any way.

Example 1

Figure 6:
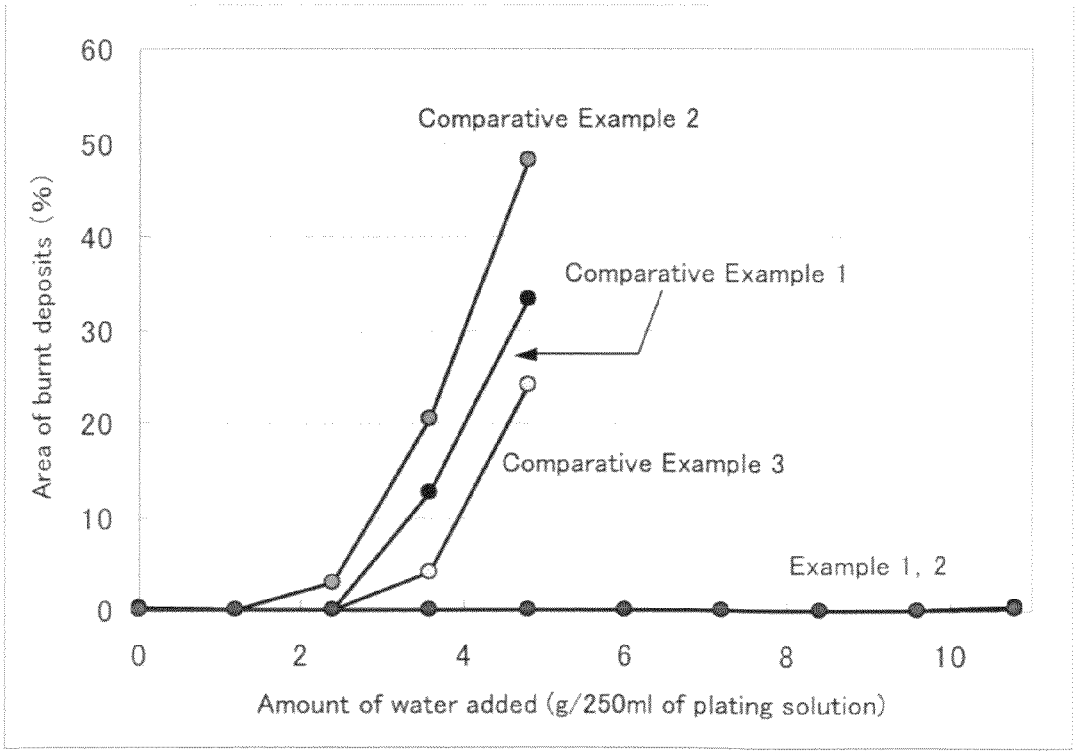
FIG. 6 A graph showing the results of image analysis to calculate the area of burnt deposits in Examples 1 and 2 and Comparative Examples 1, 2, and 3, regarding the relationship between the amount of water added to a plating solution and the appearance of an aluminum plating film formed on the surface of an oxygen-free copper plate.

Dimethyl sulfone, anhydrous aluminum chloride, and ammonium chloride were mixed in a ratio of 10:3:0.5 (molar ratio) and melted by heating to 110° C., thereby preparing an aluminum electroplating solution. In 250 mL of the plating solution, a 40 mm×20 mm×2 mm pure aluminum plate (A1090) as an anode and a 20 mm×20 mm×0.5 mm oxygen-free copper plate with a purity of 99.99% (previously immersed in a 10 mL/L aqueous nitric acid solution to remove the surface oxide film, washed with water, and thoroughly dried with warm air) as a cathode, which was to serve as a substrate to be plated, were placed. An electric current was passed therethrough at 110° C. and an applied current density of 3.0 A/dm$^2$ for 60 minutes to perform a plating process. As a result, a white and uniform aluminum plating film (thickness: about 40 μm) was formed on the surface of the substrate to be plated. Next, in order to examine how the moisture contained in the plating solution would affect the aluminum plating film formed on the surface of the substrate to be plated, 1.2 g of water was added to 250 mL of the plating solution, and, after taking enough time to complete the reaction between the plating solution and water, a plating process was performed under the same conditions as above. Then, successively, water was further added thereto in an amount of 1.2 g each time, and the same operation was repeated. Regarding the relationship between the amount of water added to the plating solution and the appearance of the plating film formed on the surface of the substrate to be plated, FIG. 1 shows the results of visual observation, and FIG. 6 shows the results of image analysis to calculate the area of burnt deposits. As is clear from FIG. 1 and FIG. 6, no burnt deposits occurred even when the amount of water added was 10.8 g, but bare spots in the form of streaks occurred when the amount of water added reached 9.6 g. These results show that at least when the amount of water added is up to 8.4 g, the plating process can be well performed.

Example 2

Figure 2:
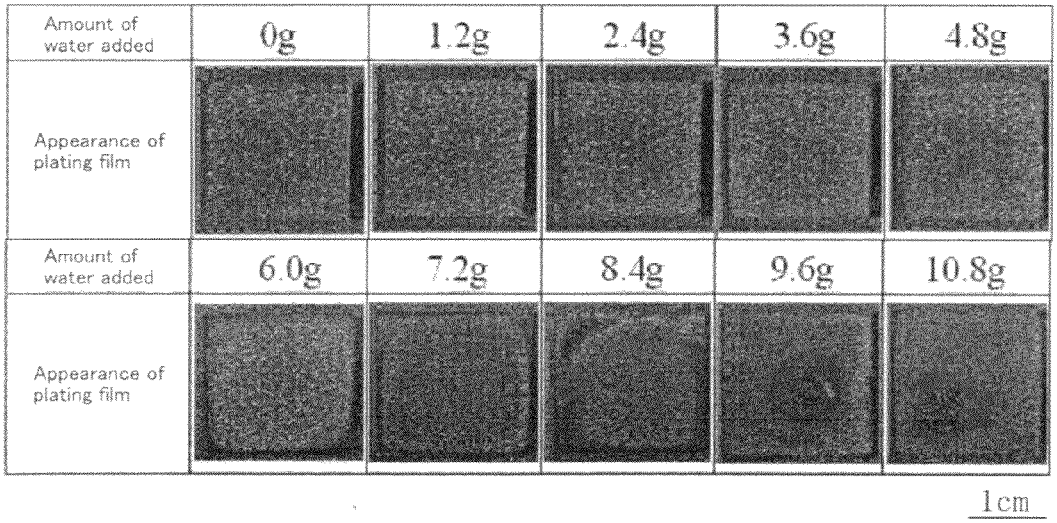
FIG. 2 Similarly, photographs showing the results in Example 2.

Dimethyl sulfone, anhydrous aluminum chloride, and tetramethylammonium chloride were mixed in a ratio of 10:3:1 (molar ratio) and melted by heating to 110° C., thereby preparing an aluminum electroplating solution. Using this plating solution, how the moisture contained in the plating solution would affect the aluminum plating film formed on the surface of the substrate to be plated was examined in the same manner as in Example 1. FIG. 2 shows the results of visual observation, and FIG. 6 shows the results of image analysis to calculate the area of burnt deposits. As is clear from FIG. 2 and FIG. 6, no burnt deposits occurred even when the amount of water added was 10.8 g, but color unevenness occurred when the amount of water added reached 7.2 g. These results show that at least when the amount of water added is up to 6.0 g, the plating process can be well performed.

Comparative Example 1

Figure 3:
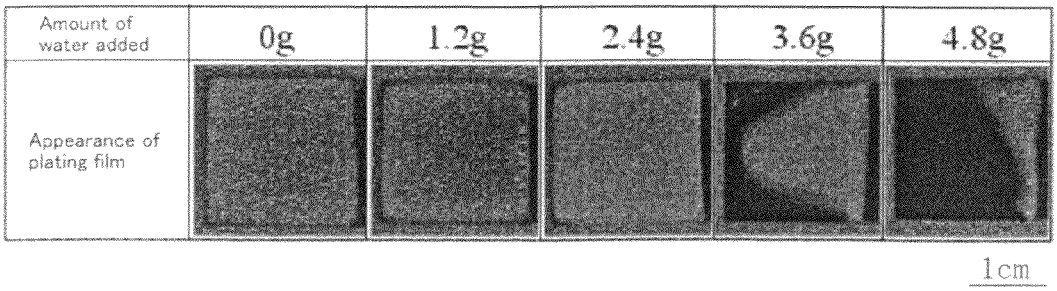
FIG. 3 Similarly, photographs showing the results in Comparative Example 1.

Dimethyl sulfone and anhydrous aluminum chloride were mixed in a ratio of 10:2 (molar ratio) and melted by heating to 110° C., thereby preparing an aluminum electroplating solution. Using this plating solution, how the moisture contained in the plating solution would affect the aluminum plating film formed on the surface of the substrate to be plated was examined in the same manner as in Example 1. FIG. 3 shows the results of visual observation, and FIG. 6 shows the results of image analysis to calculate the area of burnt deposits. As is clear from FIG. 3 and FIG. 6, no burnt deposits occurred when the amount of water added was 2.4 g, but burnt deposits occurred when the amount of water added reached 3.6 g. This shows that the plating solution of Example 1 and the plating solution of Example 2 have longer lives than this plating solution because they contain ammonium chloride and tetramethylammonium chloride, respectively.

Comparative Example 2

Figure 4:
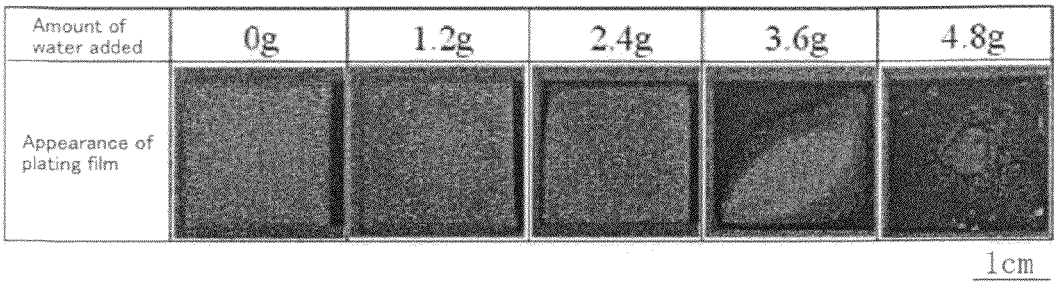
FIG. 4 Similarly, photographs showing the results in Comparative Example 2.

Dimethyl sulfone and anhydrous aluminum chloride were mixed in a ratio of 10:4 (molar ratio) and melted by heating to 110° C., thereby preparing an aluminum electroplating solution. Using this plating solution, how the moisture contained in the plating solution would affect the aluminum plating film formed on the surface of the substrate to be plated was examined in the same manner as in Example 1. FIG. 4 shows the results of visual observation, and FIG. 6 shows the results of image analysis to calculate the area of burnt deposits. As is clear from FIG. 4 and FIG. 6, the occurrence of burnt deposits was slightly observed when the amount of water added was 2.4 g, and the occurrence of burnt deposits was prominent when the amount of water added reached 3.6 g. This shows that the plating solution of Example 1 and the plating solution of Example 2 have longer lives than this plating solution because they contain ammonium chloride and tetramethylammonium chloride, respectively.

Comparative Example 3

Dimethyl sulfone, anhydrous aluminum chloride, and dimethylamine hydrochloride were mixed in a ratio of 10:3:0.2

Figure 5:
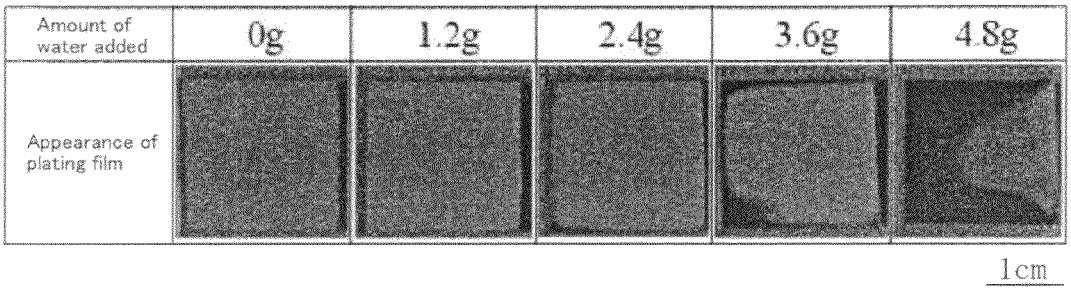
FIG. 5 Similarly, photographs showing the results in Comparative Example 3.

(molar ratio) and melted by heating to 110° C., thereby preparing an aluminum electroplating solution. Using this plating solution, how the moisture contained in the plating solution would affect the aluminum plating film formed on the surface of the substrate to be plated was examined in the same manner as in Example 1. FIG. 5 shows the results of visual observation, and FIG. 6 shows the results of image analysis to calculate the area of burnt deposits. As is clear from FIG. 5 and FIG. 6, the occurrence of burnt deposits was slightly observed when the amount of water added was 3.6 g, and the occurrence of burnt deposits was prominent when the amount of water added reached 4.8 g. This shows that unlike ammonium chloride or tetramethylammonium chloride, dimethylamine hydrochloride does not have a life-extending effect on a plating solution.

Comparative Example 4

Dimethyl sulfone, anhydrous aluminum chloride, and ammonium chloride were mixed in a ratio of 10:3:1 (molar ratio) and melted by heating to 110° C., thereby preparing an aluminum electroplating solution. Using this plating solution, a plating process was performed under the same plating conditions as in Example 1. As a result, bubbles were formed in the plating solution, and, due to the contact of the formed bubbles with the substrate to be plated, bare spots in the form of streaks were present on the surface of the aluminum plating film. This shows that in a plating solution containing ammonium chloride in a molar ratio of 1/3 relative to anhydrous aluminum chloride, the ammonium chloride content is too large, and a plating process cannot be well performed (a separate experiment has been performed to confirm that although the amount of aluminum complex ions ($Al(DMSO_2)_3^{3+}$ present in a plating solution decreases with an increase in the amount of ammonium chloride added, when the amount added is up to 1/4 in terms of molar ratio to an aluminum halide, the amount of aluminum complex ions present does not become 0).

Comparative Example 5

Dimethyl sulfone, anhydrous aluminum chloride, and tetramethylammonium chloride were mixed in a ratio of 10:3:2 (molar ratio) and melted by heating to 110° C., thereby preparing an aluminum electroplating solution. Using this plating solution, a plating process was performed under the same plating conditions as in Example 1. As a result, no aluminum plating film was formed on the surface of the substrate to be plated. This shows that in a plating solution containing tetramethylammonium chloride in a molar ratio of 2/3 relative to anhydrous aluminum chloride, the tetramethylammonium chloride content is too large, and a plating process cannot be well performed (a separate experiment has been performed to confirm that although the amount of aluminum complex ions ($Al(DMSO_2)_3^{3+}$) present in a plating solution decreases with an increase in the amount of tetramethylammonium chloride added, when the amount added is up to 1/2 in terms of molar ratio to an aluminum halide, the amount of aluminum complex ions present does not become 0).

Comparative Example 6

Dimethyl sulfone, anhydrous aluminum chloride, and dimethylamine hydrochloride were mixed in a ratio of 10:3:0.75 (molar ratio) and melted by heating to 110° C., thereby preparing an aluminum electroplating solution. Using this plating solution, a plating process was performed under the same plating conditions as in Example 1. As a result, color unevenness and bare spots in the form of streaks were present on the aluminum plating film formed on the surface of the substrate to be plated. This shows that unlike ammonium chloride or tetramethylammonium chloride, dimethylamine hydrochloride does not have a life-extending effect on a plating solution.

Comparative Example 7

Dimethyl sulfone, anhydrous aluminum chloride, and dimethylamine borane were mixed in a ratio of 10:2:0.1 (molar ratio) and melted by heating to 110° C., thereby preparing an aluminum electroplating solution. Using this plating solution, how the moisture contained in the plating solution would affect the aluminum plating film formed on the surface of the substrate to be plated was examined in the same manner as in Example 1. As a result, when 1.2 g of water was added to 250 mL of the plating solution to cause a reaction between the plating solution and water, the plating solution ignited with a green flame. This shows that unlike ammonium chloride or tetramethylammonium chloride, dimethylamine borane does not have a life-extending effect on a plating solution.

Example 3

Figure 7:
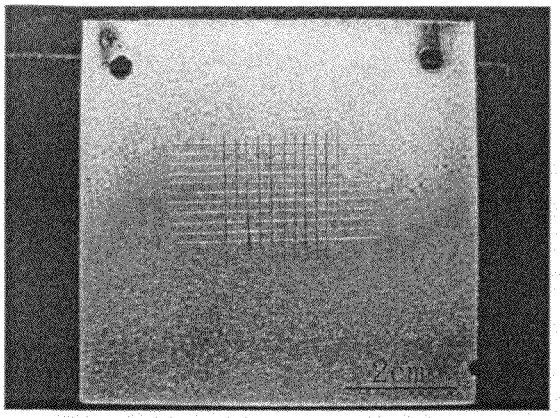
FIG. 7 A photograph showing the result of a cross-cut test to evaluate the adhesion of an aluminum plating film formed on the surface of an oxygen-free copper plate to the oxygen-free copper plate in Example 3.

A plating process was performed under the same plating conditions as in Example 1, except that the aluminum electroplating solution prepared in Example 2 was used, and also that a 70 mm×70 mm×0.5 mm oxygen-free copper plate with a purity of 99.99% (previously immersed in a 10 mL/L aqueous nitric acid solution to remove the surface oxide film, washed with water, and thoroughly dried with warm air) was used as a substrate to be plated. An aluminum plating film was thus formed on the surface of the substrate to be plated. FIG. 7 shows the result of a cross-cut test to evaluate the adhesion of the plating film formed on the surface of the substrate to be plated to the substrate to be plated. As is clear from FIG. 7, no separation of the plating film from the substrate to be plated was observed, showing that the plating film is formed with excellent adhesion to the surface of the substrate to be plated.

Example 4

Figure 8:
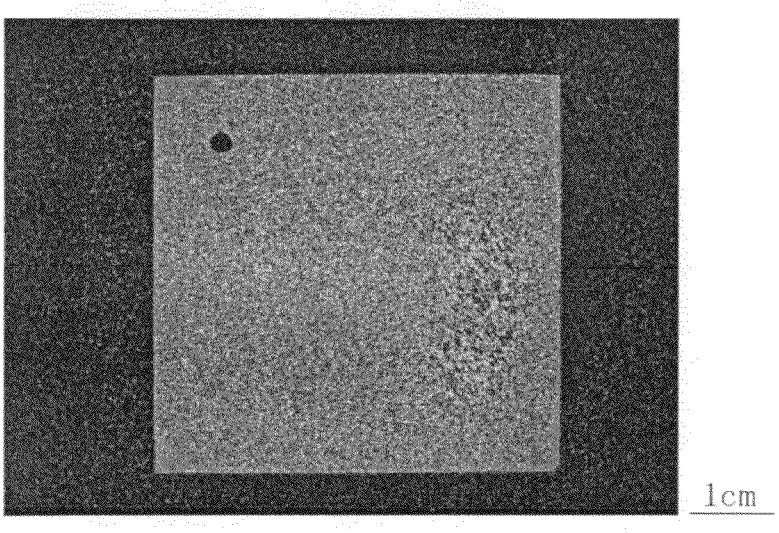
FIG. 8 A photograph showing the result of the visual observation of the appearance of a magnesium alloy plate having an aluminum plating film on the outermost surface thereof in Example 4.
Figure 9:
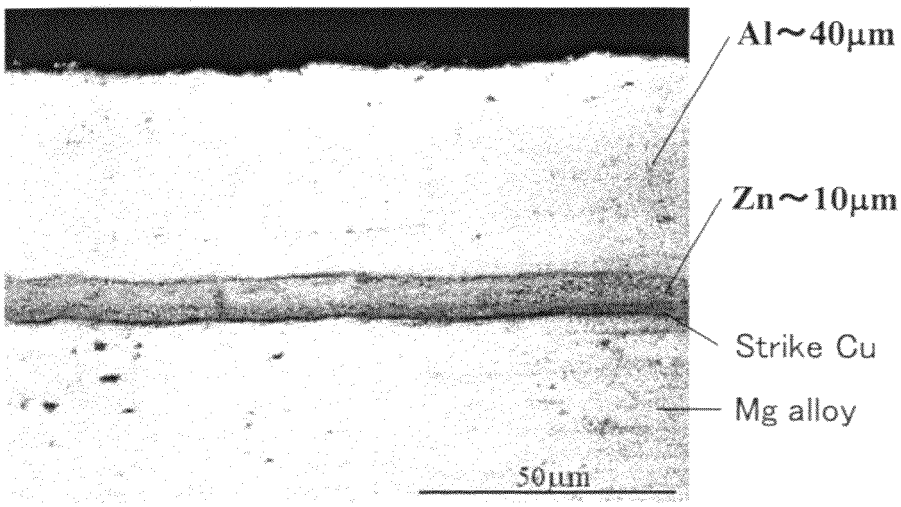
FIG. 9 Similarly, a photograph showing the result of the cross-sectional observation.
Figure 10:
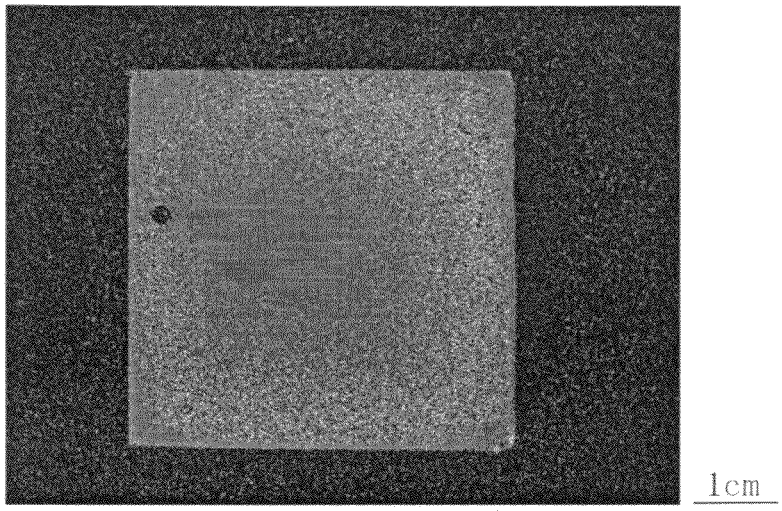
FIG. 10 Similarly, a photograph showing the result of the visual observation of the appearance after a neutral salt spray test.

A plating process was performed under the same plating conditions as in Example 1, except that the aluminum electroplating solution prepared in Example 2 was used, and also that a material prepared by subjecting a 50 mm×50 mm×1.0 mm magnesium alloy plate (AZ31 rolled material) to zincate process, strike copper plating process, and electrogalvanizing process, successively, so as to form a zinc plating film as the outermost surface, followed by thorough drying, was used as a substrate to be plated. An aluminum plating film (thickness: about 40 μm) was thus formed on the surface of the zinc plating film. FIG. 8 shows the result of the visual observation of the appearance of the magnesium alloy plate having the aluminum plating film on the outermost surface thereof, and FIG. 9 shows the result of the cross-sectional observation. As is clear from FIG. 8 and FIG. 9, it was shown that the aluminum plating film formed on the outermost surface of the magnesium alloy plate is white, uniform, and also dense. The magnesium alloy plate having the aluminum plating film on the outermost surface thereof was oxidized using 100° C. hot water for 1 hour to form an oxide film on the surface, and then a neutral salt spray test was performed for 96 hours. FIG. 10 shows the result of the visual observation of the appearance after the neutral salt spray test. As is clear from FIG. 10, no rusting occurred on the surface of the aluminum plating film, showing excellent corrosion resistance. Further, by subjecting the magnesium alloy plate having the aluminum plating film on the outermost surface thereof to anodization process, the aluminum plating film was colored as in the case of a pure aluminum material, etc. These results show that the formation of an aluminum plating film on the surface of a magnesium alloy plate makes it possible to impart corrosion resistance or design features.

Example 5

Figure 11:
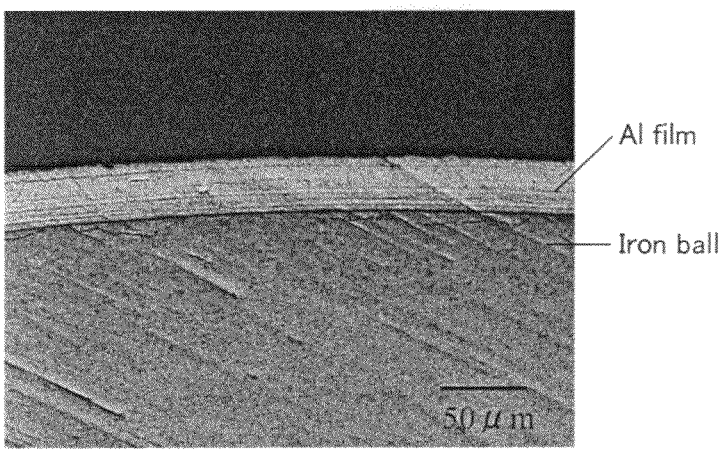
FIG. 11 A photograph showing the result of the cross-sectional observation of an iron ball having an aluminum plating film on the surface thereof in Example 5.

Dimethyl sulfone, anhydrous aluminum chloride, and tetramethylammonium chloride were mixed in a ratio of 10:2:1 (molar ratio) and melted by heating to 110° C., thereby preparing, an aluminum electroplating solution. In this plating solution, a 70 mm×70 mm×1 mm aluminum plate with a purity of 99.99% was placed as an anode. Further, a barrel made of Teflon (registered trademark) in the shape of a hexagonal prism with 2 cm on a side and a length of 5 cm, having placed therein 180 iron balls with a diameter of 5 mm (substrate to be plated) and 1 copper ball with a diameter of 10 mm having a lead wire connected thereto, was placed in the plating solution, so that the iron balls and the lead wire were electrically connected via the copper ball to give a cathode. While rotating the barrel at a rotational speed of 10 rpm, an electric current was passed therethrough at 110° C. and an applied current density of 4.0 $A/dm^2$ for 50 minutes to perform a plating process. As a result, a white and uniform aluminum plating film (thickness: about 40 μm) was formed on the surface of the iron balls. FIG. 11 shows the result of the cross-sectional observation of the iron ball having the aluminum plating film on the surface thereof. As is clear from FIG. 11, it was shown that a dense aluminum plating film is formed on the surface of the iron balls.

Comparative Example 8

Figure 12:
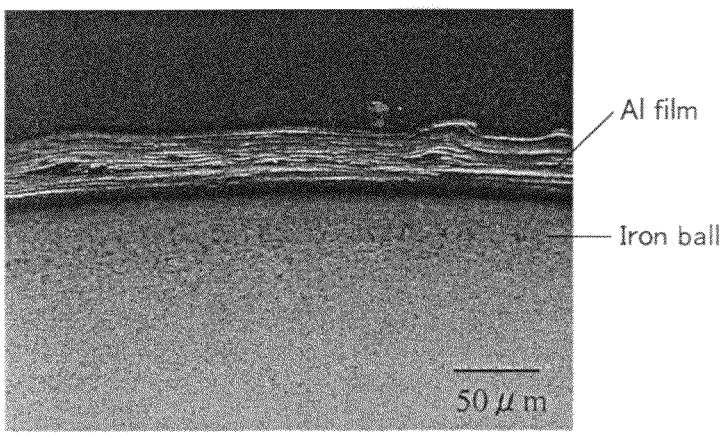
FIG. 12 A photograph showing the result of the cross-sectional observation of an iron ball having an aluminum plating film on the surface thereof in Comparative Example 8.
Figure 13:
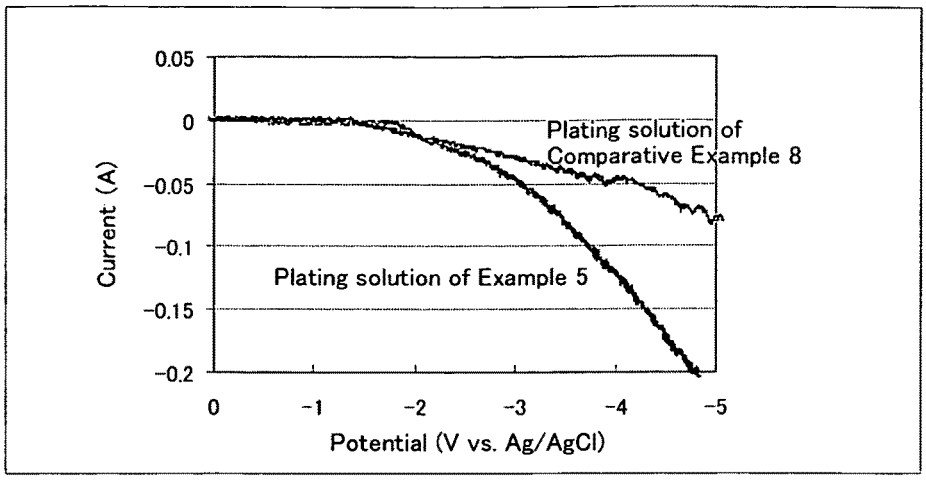
FIG. 13 A graph showing the electrical conductivity of a plating solution of Example 5 and that of a plating solution of Comparative Example 8.

Dimethyl sulfone and anhydrous aluminum chloride were mixed in a ratio of 10:2 (molar ratio) and melted by heating to 110° C., thereby preparing an aluminum electroplating solution. Using this plating solution, a plating process was performed by the same barrel method as in Example 5 to form an aluminum plating film (thickness: about 40 μm) on the surface of the iron balls. FIG. 12 shows the result of the cross-sectional observation of the iron ball having the aluminum plating film on the surface thereof. As is clear from FIG. 12, it was shown that the aluminum plating film formed on the surface of the iron ball is formed in layers with a separation between the layers, and thus is non-uniform. FIG. 13 shows the electrical conductivity of the plating solution of Example 5 and that of the plating solution of Comparative Example 8. As is clear from FIG. 13, it was shown that the electrical conductivity of the plating solution of Example 5 is greatly different from that of the plating solution of Comparative Example 8, and such a difference in the electrical conductivity is reflected in the properties of the aluminum plating films formed on the surfaces of the iron balls. It was also shown that when a plating solution contains tetramethylammonium chloride, the electrical conductivity is improved (the greater the polarization curve gradient, the higher the electrical conductivity).

INDUSTRIAL APPLICABILITY

According to the present invention, a plating solution that allows an aluminum electroplating process to be performed stably for a long period of time even when the amount of moisture incorporated therein gradually increases and, in addition, also allows the formation of a uniform aluminum plating film on a substrate to be plated even when the plating process is performed by a barrel method can be provided, as well as a method for forming an aluminum plating film using the same. In this respect, the present invention is industrially applicable.

The invention claimed is:

1. An aluminum electroplating solution comprising 1.5 to 4.0 mol of an aluminum halide per 10.0 mol of dimethyl sulfone and, relative to the aluminum halide, ammonium chloride in a molar ratio of 1/15 to 1/4 or a tetraalkylammonium chloride in a molar ratio of 1/15 to 1/2.

2. The aluminum electroplating solution according to claim 1, characterized in that the aluminum halide is aluminum chloride.

3. The aluminum electroplating solution according to claim 1, characterized in that the aluminum halide is an anhydride.

4. The aluminum electroplating solution according to claim 1, characterized in that the tetraalkylammonium chloride is tetramethylammonium chloride.

5. A method for forming an aluminum plating film, comprising the steps of:

placing a substrate to be plated as a cathode in the aluminum electroplating solution according to claim 1, and passing an electric current through the cathode and the aluminum electroplating solution to form an aluminum plating film on a surface of the substrate to be plated.

* * * * *